United States Patent [19]

Gabellieri et al.

[11] 3,975,163

[45] Aug. 17, 1976

[54] APPARATUS FOR THE RECOVERY OF FIBRILS MADE OF SYNTHETIC POLYMER

[75] Inventors: Rodolfo Gabellieri, Brussels, Belgium; Carlo Raganato, Castiglioncello, Italy

[73] Assignee: Solvay & Cie, Brussels, Belgium

[22] Filed: Mar. 4, 1974

[21] Appl. No.: 448,040

[30] Foreign Application Priority Data

Mar. 2, 1973 Luxemburg ..... 67153

[52] U.S. Cl. ..... 23/272.6 R; 23/285; 23/290; 23/290.5; 23/271 R

[51] Int. Cl.[2] ..... B01F 3/12; B01F 7/06

[58] Field of Search ..... 23/273 R, 271 R, 271 M, 23/267 R, 252 R, 272.6 R, 285, 290, 290.5; 260/94.9; 159/DIG. 10, 42

[56] References Cited

UNITED STATES PATENTS

| | | | |
|---|---|---|---|
| 2,573,949 | 11/1951 | Blizzard | 23/271 P |
| 2,762,756 | 9/1956 | Kinnaird, Jr. | 23/271 R |
| 2,957,855 | 10/1960 | McLeod | 159/DIG. 10 |
| 2,969,347 | 1/1961 | Bellinger | 23/271 P |
| 3,202,647 | 8/1965 | Todd | 159/DIG. 10 |
| 3,251,428 | 5/1966 | Tabler | 159/DIG. 10 |
| 3,296,240 | 1/1967 | MacDonald | 159/DIG. 10 |
| 3,456,708 | 7/1969 | Jansson | 159/42 |
| 3,607,101 | 9/1971 | Cochran | 23/273 R |

FOREIGN PATENTS OR APPLICATIONS

| | | | |
|---|---|---|---|
| 38-338 | 1/1963 | Japan | 23/285 |
| 1,228,836 | 4/1971 | United Kingdom | 159/DIG. 10 |

*Primary Examiner*—Stephen J. Emery
*Attorney, Agent, or Firm*—Spencer & Kaye

[57] ABSTRACT

Fibrils made of synthetic polymer and which are in the presence of vapors of an organic solvent are recovered in a closed chamber containing a liquid for suspending the fibrils and a gaseous atmosphere. The chamber contains means for introducing the fibrils and solvent vapors into the closed chamber, means for discharging the solvent vapors from the closed chamber, means for introducing into the closed chamber liquid for suspending the fibrils, and means for withdrawing the suspension of fibrils from the closed chamber.

8 Claims, 3 Drawing Figures

APPARATUS FOR THE RECOVERY OF FIBRILS MADE OF SYNTHETIC POLYMER

BACKGROUND OF THE INVENTION

The present invention relates to a method and an apparatus for the recovery, in the form of a suspension in a liquid, of fibrils made of synthetic polymer which are in the presence of vapors of an organic solvent.

Various processes have been proposed which enable fibrils or fibrillated structures to be produced from synthetic polymers.

Thus, according to Belgian Pat. No. 568,524, issued June 11th, 1958 in the name of E. I. du Pont de Nemours, continuous structures consisting of a multitude of strands or fibrillar sections which gather together and separate at irregular intervals to form a "unitary fibrillar plexus" are produced by extruding a solution of a synthetic polymer, which is at a temperature above the normal boiling point of the solvent and under the autogenic pressure or under a higher pressure, through an orifice of suitable shape, into a zone of lower pressure.

According to this technique, the instantaneous vaporization of the solvent of the polymer solution at the instant when the pressure is suddenly released leads to the formation of continuous fibrillated structures which are discharged at very high speed and which is obviously accompanied by the formation of a very large volume of solvent vapors.

According to another technique, disclosed in Belgian Pat. No. 787,032 issued on Sept. 1st, 1972, discontinuous fibrils are produced by suddenly releasing the pressure acting on a two-phase liquid mixture of molten polymer and solvent which is at a high temperature and a high pressure, by passing it through an orifice, so as to bring about the instantaneous vaporization of the solvent and solidify the polymer, when an added fluid is introduced into the said two-phase liquid mixture before the release of pressure is complete. The added fluid can be identical to the solvent used to produce the two-phase liquid mixture. This second technique also causes a large volume of solvent vapors to be produced.

According to a third technique, disclosed in Belgian Pat. No. 787,033 issued on Sept. 1st, 1972, discontinuous fibrils are also produced by suddenly releasing the pressure acting on a two-phase liquid mixture of molten polymer and solvent which is at a high temperature and a high pressure so as to bring about the instantaneous vaporization of the solvent and to form a continuous fibrillated structure, and by shredding the continuous fibrillated structure thus produced, as it is formed, by means of a transverse stream of fluid.

The fluid forming the transverse stream can be identical to the solvent used to produce the two-phase liquid mixture. The production of discontinuous fibrils in accordance with this latter technique also leads to the evolution of large volumes of solvent vapors.

It is thus apparent that the various techniques for the production of fibrils made of synthetic polymer involve the use of very large quantities of an organic solvent which is vaporized completely at the last stage of the manufacturing process.

Consequently, in order especially to reduce the manufacturing costs, these solvent vapors have to be recovered so as to make it possible to recycle the solvent after condensation. Furthermore, this recovery is absolutely necessary and poses very significant problems when these solvent vapors are toxic or present the risk of forming explosive mixtures with oxygen.

There has also been proposed a process and an apparatus which make it possible to recover fibrils made of synthetic polymer which are in the presence of solvent vapors.

According to this process, the fibrils are recovered in the form of a web on a porous support which moves through a closed chamber containing vapors of a liquid which is not miscible with the organic solvent and is inert with respect to the polymer forming the fibrils, while the solvent vapors are extracted continuously from this chamber by suction. This web of fibrils, which is removed continuously from the closed chamber, possesses a certain internal cohesion and can be dried, wound up, stored and transported.

The fibrils of synthetic polymer of which the web is made are used most frequently as a starting material for the paper-making industry. They are processed like natural paper pulps prepared from wood. They thus undergo conventional operations of paper-making technique such as refining, lump disintegration, mixing and deposition on flat or round table machines. In order to do this, they must be employed in the form of a suspension in a liquid which is generally water. This suspension must be very homogenous and the fibrils therein must be finely divided. This is why the suspending of fibrils, starting from webs, is a long and delicate operation which ties up a large amount of equipment and is expensive in relation to the amount of energy consumed.

SUMMARY OF THE INVENTION

In accordance with the present invention, there has now been developed a method and an apparatus which permit the direct recovery, in the form of a suspension in a liquid, of fibrils made of synthetic polymer which are in the presence of vapors of an organic solvent.

The operations of forming, drying, winding up and transporting the web are thus eliminated, as is the suspending of the fibrils starting from the web.

The apparatus according to the present invention comprises a closed chamber for containing a liquid for suspending the fibrils and a gaseous atmosphere, means for introducing the fibrils and solvent vapors into the closed chamber, means for discharging the solvent vapors from the closed chamber, means for introducing liquid into the closed chamber for suspending the fibrils and means for drawing off the suspension of fibrils from the closed chamber.

Preferably, the means for introducing the fibrils and solvent vapors into the closed chamber is a pipe, the means for discharging the solvent vapors is a pipe, the means for introducing liquid into the closed chamber for suspending the fibrils is a pipe, and the means for drawing off the suspension of fibrils is a pipe.

The method according to the present invention comprises continuously introducing into a closed chamber maintained free of air liquid for suspending the fibrils, continuously introducing the fibrils and solvent vapors into the closed chamber and forming in the closed chamber a suspension of the fibrils in the liquid, continuously discharging the solvent vapors from the closed chamber, and continuously withdrawing the suspension of fibrils from the closed chamber.

GENERAL ASPECTS OF THE INVENTION

As a general rule, the closed chamber is equipped with means for controlling the pressure within the closed chamber. This means for controlling the pressure can be of any type whatsoever, but it is, however, advisable to take account of the fact that the total pressure prevailing in the closed chamber, when the apparatus is functioning, is preferably slightly higher than atmospheric pressure in order to prevent any air from accidentally entering this chamber.

For this purpose, it is preferred that the means for controlling the pressure should be adjusted so that the excess pressure in the closed chamber relative to atmospheric pressure remains between 50 and 500 mm of water, and preferably between 150 and 450 mm of water.

According to a preferred embodiment of the present invention, the means for controlling the pressure within the closed chamber includes a first means such as, for example, a hydraulic guard device of 450 to 500 mm of water, to prevent an excessive rise in pressure, and a second means to prevent the closed chamber from being placed under reduced pressure. This second means can be a plurality of devices which can act at different levels either separately, successively or simultaneously.

Thus, for example, the means for preventing a reduced pressure can include a first device in the form of a pressure actuated valve which acts on the pipe for discharging the solvent vapors. This valve will compensate for reduction in pressure by automatically reducing the amount of solvent vapors discharged from the closed chamber when the pressure in the chamber begins to decrease.

According to another embodiment of the present invention, the upper part of the closed chamber, where the gaseous atmosphere is located, can be equipped with a means for introducing vapors of the organic solvent directly into the gaseous atmosphere, this means being regulated by the means for controlling the pressure in such a way that it is actuated when the pressure in the closed chamber falls below a predetermined minimum. Thus, for example, the means for introducing vapors of the organic solvent can be a pipe, and the means for controlling the pressure can include a second device in the form of a pressure actuated valve which acts on the pipe for introducing the solvent vapors. This valve will automatically compensate for reduction in pressure by introducing additional solvent vapors into the closed chamber when the pressure in the chamber begins to decrease. It is to be understood that this means for introducing organic solvent vapors into the gaseous atmosphere is separate from and in addition to the means which introduces both fibrils and solvent vapors into the closed chamber.

Finally, as a safety measure, when the apparatus according to the invention is required for use with an installation for the production of fibrils which operates with inflammable solvents, it is also advisable to provide, in the upper part of the closed chamber, a further means for introducing an inert gas regulated by the means for controlling the pressure so as to be brouoght into use as a last resort in order to overcome a dangerous drop in pressure. Thus, for example, the means for introducing inert gas can be a pipe, and the means for controlling the pressure can include a third device in the form of a pressure actuated valve which acts on the pipe for introducing the inert gas. This valve will compensate for reduction in pressure by automatically allowing inert gas to be fed into the closed chamber when the pressure in the chamber begins to decrease.

As a general rule, during normal functioning of the apparatus, the variations in pressure are taken care of by operating the means for controlling the pressure solely at the level of the pipeline for discharging the solvent vapors.

The closed chamber can also be equipped with means, which can be of any type whatsoever, for keeping the level of liquid for suspending the fibrils constant. This level can be maintained, for example, by varying either the rate at which the suspension is drawn off, in the case of excess, or, in the case of lack, the rate at which the suspending liquid is introduced. The closed chamber preferably is provided with recycle means to recycle through the chamber a portion of the suspension of fibrils extracted by the withdrawal device. The recycle means preferably includes means to control the rate of recycle and when the liquid level in the closed chamber begins to decrease, the level can be maintained constant by varying the rate at which the suspension of fibrils and suspending liquid are recycled through the closed chamber. This latter variant is the preferred variant for maintaining the level constant because it makes it possible to draw off suspensions of more constant concentrations.

Finally, the closed chamber can also be equipped with means for introducing organic solvent vapor and/or inert gases not regulated by the means for controlling the pressure inside the chamber. These means for introducing organic solvent vapor and/or inert gases preferably open into the gaseous atmosphere.

The closed chamber is preferably thermostatted, for example by means of heat insulation and heating elements controlled so as to maintain a suitable internal temperature.

This internal temperature must preferably be higher than the temperature at which the vapors of the organic solvent used condense under the pressure conditions prevailing in the closed chamber. It is also advisable for the temperature prevailing in the closed chamber to be below the boiling point of the liquid for suspending the fibrils under the pressure conditions of the said chamber.

As a general rule, the closed chamber is equipped with means which make it possible to maintain its internal temperature at a constant value of between 50° and 100°C.

The means for introducing the fibrils and the organic solvent vapors preferably is a tubular pipe into which the device for producing the fibrils opens and which does not have any outlet to outside the closed chamber. The device for producing the fibrils generally comprises a spinneret which brings about the sudden release of pressure acting on a two-phase liquid mixture of molten polymer and solvent and the shredding of the fibrillated structure thus produced or another equivalent means. The tubular pipe for introducing the fibrils and solvent vapors preferably extends inside the closed chamber. The best results are obtained when it opens into the liquid for suspending the fibrils which is present in the closed chamber.

It has been found, in fact, that this latter embodiment of the invention wherein the tubular pipe opens into the liquid for suspending the fibrils which is present in the closed chamber, is particularly advantageous because it makes it possible to obtain suspensions of fibrils of very good quality. This result can be explained by the fact that the solvent vapors create very powerful agitation as they issue at high speed into the liquid for suspending the fibrils. This is the reason why the cross-section of the tubular pipeline is preferably chosen so that the speed of the solvent vapors, at the outlet, is greater than 1 m/second and more particularly greater than 5 m/second.

Finally, it is useful to provide a shut-off valve on this pipe for introducing the fibrils and solvent vapors into the closed chamber in order to prevent the closed chamber from being exposed to the atmosphere, for example when the device for producing the fibrils is being cleaned or replaced. The closed chamber is maintained free of air during the recovery process to prevent explosive mixtures of oxygen and solvent vapors from forming in the closed chamber. To accomplish this, the pipe for introducing the fibrils and solvent vapors into the closed chamber is directly connected to the device for forming the fibrils so that no air enters into this pipe.

The means for removing the solvent vapors preferably is a pipe which connects the upper part of the chamber containing the gaseous atmosphere to the installation for recovering the solvent. In addition to a pressure actuated valve on this pipe, which as previously described can be used to control the pressure in the closed chamber when the pressure begins to decrease, it is optionally possible to provide for a filter to be placed on this system of pipes in order to prevent fibrils from being accidentally carried along by the solvent vapors.

The means for introducing the liquid for suspending the fibrils preferably is a pipe connected to a source of the said liquid equipped with a valve with an adjustable flow rate. It can discharge its contents at any level whatsoever.

However, according to a preferred embodiment of the present invention, the means for introducing the liquid for suspending the fibrils consists of spray means comprising a plurality of spray devices arranged in a ring in the means for introducing the fibrils. These spray devices, such as spray nozzles, are distributed around the device for producing the fibrils in the tubular pipe which introduces the fibrils and solvent vapors into the closed chamber and surrounds this device. These spray devices are preferably inclined in a manner such that the injection of the liquid promotes the forward movement of the fibrils through the tubular pipeline.

The closed chamber usually includes a stirring device which can be of any type whatsoever and which acts on the liquid for suspending the fibrils. It is preferred to use a stirrer with blades positioned either on the lower part of the side wall of the closed chamber or on the base of this chamber. The action of this stirring device can optionally be reinforced by suitable deflectors on the inside wall of the closed chamber.

The means for drawing off the suspension of fibrils preferably is a discharge pipe which is situated at the base of the closed chamber and is equipped with an adjustable valve. This discharge pipe preferably is connected either to a storage reservoir or directly to a paper-making line.

According to a variant, and as previously discussed, the closed chamber can be equipped with means which makes it possible to recycle, through this chamber, a portion of the suspension of fibrils extracted by the withdrawal device.

This device for recycling can consist of a by-pass mounted on the pipe for discharging the suspension of fibrils and connected, via a control valve and a pump, to an injection device provided on the upper part of the closed chamber.

The closed chamber can also advantageously be equipped with devices which make it possible to read and record the internal pressure and temperature, means for checking the level of liquid inside this chamber, means for heating the liquid present in the latter, discharge means and inspection means, and the like.

As has been stated, the apparatus according to the invention makes it possible to recover, in the form of a suspension in a liquid, the fibrils made of synthetic polymer produced by any process in the presence of an organic solvent.

The term "fibrils", as used in the specification and claims means elongated fibrillated structures consisting of very thin filaments, of a thickness of the order of a micron, connected to one another to form a three-dimensional network. The general shape of these fibrils, which have a flocculent appearance, is oblong. The fibrils that are recovered in the present invention are discontinuous and their length varies approximately from 0.5 millimeter to 5 centimeters and their diameter varies approximately from 0.01 to 5 millimeters. The specific surface area of these products is very high: it is greater than 1 $m^2/g$ and in many cases greater than 10 $m^2/g$. These fibrils are an excellent starting material for the production of synthetic papers, by the usual methods.

Among the polymers which can be used for the production of these fibrils, there may be mentioned polyolefines such as polyethylene, polypropylene, copolymers of ethylene and propylene, polyisobutylene and the like, polyamides, polyesters, polyurethanes, polycarbonates, vinyl polymers such as optionally post-chlorinated polyvinyl chloride, polyvinyl fluoride and the like, and acrylic polymers such as the homopolymers and copolymers of acrylonitrile, and the like, this list being enumerative and not limiting.

Among the organic solvents employed with these polymers, there may be mentioned aliphatic hydrocarbons such as pentane, hexane, heptane, octane and their homologues and isomers, alicyclic hydrocarbons such as cyclohexane, aromatic hydrocarbons such as benzene, toluene and the like, halogenated solvents such as chlorofluoromethanes, methylene chloride, ethyl chloride and the like, alcohols, ketones, esters and ethers, as well as mixtures of these solvents. These solvents are generally toxic and a large number of them are readily inflammable and give rise to explosion risks.

The fibrils which are recovered by the process and apparatus of the present invention preferably are prepared from a "two-phase liquid mixture" which term is defined in the following paragraph.

When a very high pressure is applied to a mixture of polymer and a suitable solvent, which contains a suitable concentration of polymer and which is at a temperature above the melting point of the polymer, it is found that the mixture takes the form of a single homogeneous liquid phase. If, thereafter, the pressure is gradually reduced, while keeping all the other conditions the same, it is found that, from a certain pressure which varies depending on the particular cases, the single homogeneous liquid phase becomes cloudy due to the appearance of a system consisting of two liquid phases comprising a continuous polymer-rich liquid phase in which droplets of a polymer-depleted liquid phase are dispersed. This system is referred to as a "two-phase liquid mixture." The value of the pressure at which this phenomenon appears can easily be determined experimentally for various values of temperature and polymer concentration.

Thus, in preparing the fibrils recovered according to the invention, it is advisable to choose the pressure of the mixture subjected to sudden pressure release in such a way that it is in the form of two-phase liquid mixture. The same applies to the temperature and to the polymer concentration. The working conditions are known in the prior art and there is thus no need to further enumerate them in detail.

The liquid for suspending the fibrils in the apparatus according to the invention is preferably water, but it is very obvious that other liquids can also be suitable in some particular cases. This liquid can advantageously contain one or more additives (for example, a surface-active agent) intended to improve the stability of the suspension of fibrils.

DETAILED DESCRIPTION OF THE INVENTION

The apparatus according to the invention is further explained in more detail in the description which now follows of a practical variant. However, this description is of course given purely by way of illustration and does not imply a limitation.

BRIEF DESCRIPTION OF THE DRAWING

In the description which now follows, reference will be made to the figures of the attached drawings in which.

DESCRIPTION OF THE PREFERRED EMBODIMENTS

Figure 1:
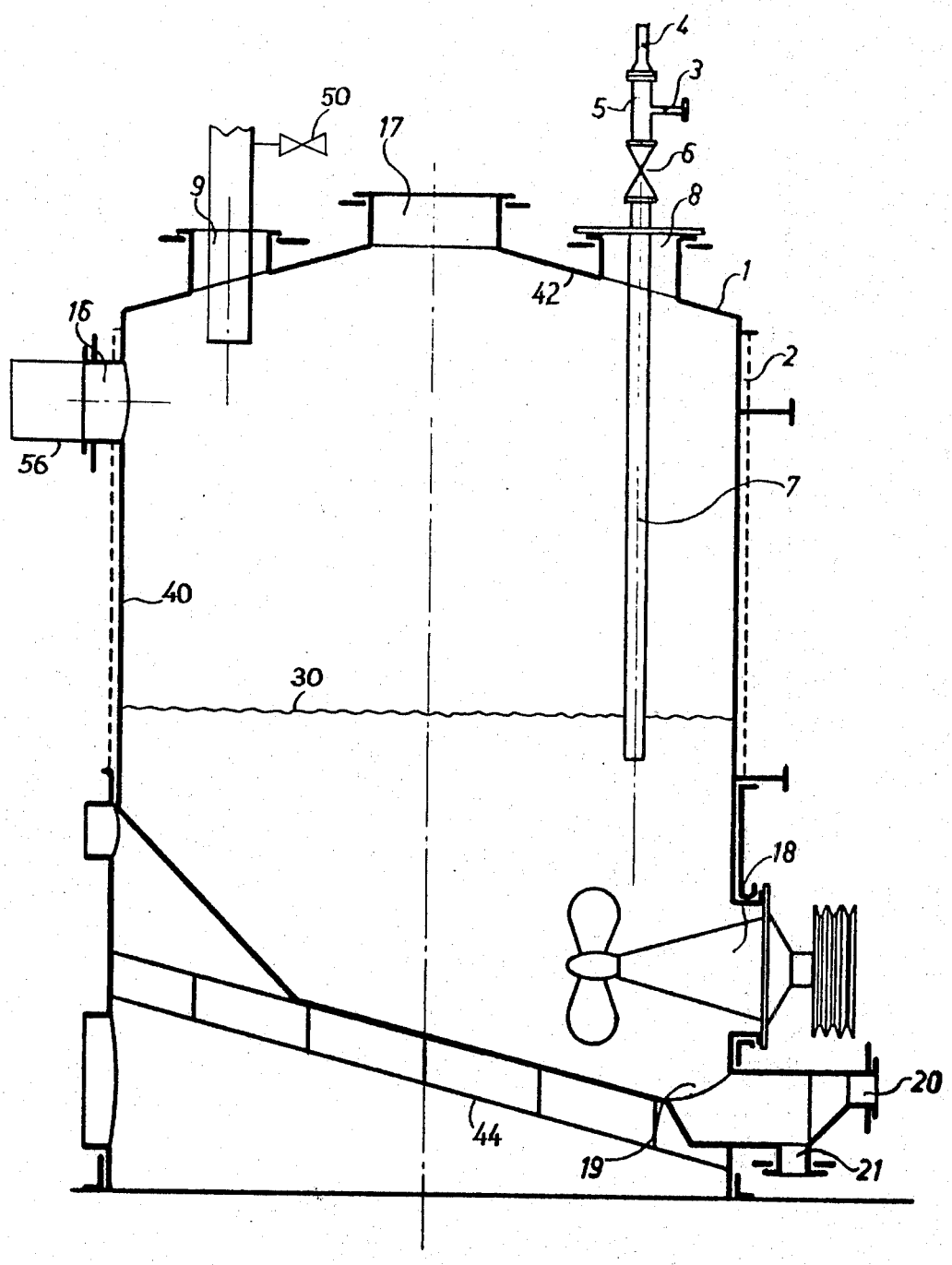
FIG. 1 is a view in elevation and in cross section of an apparatus for the recovery of fibrils according to the invention.
Figure 2:
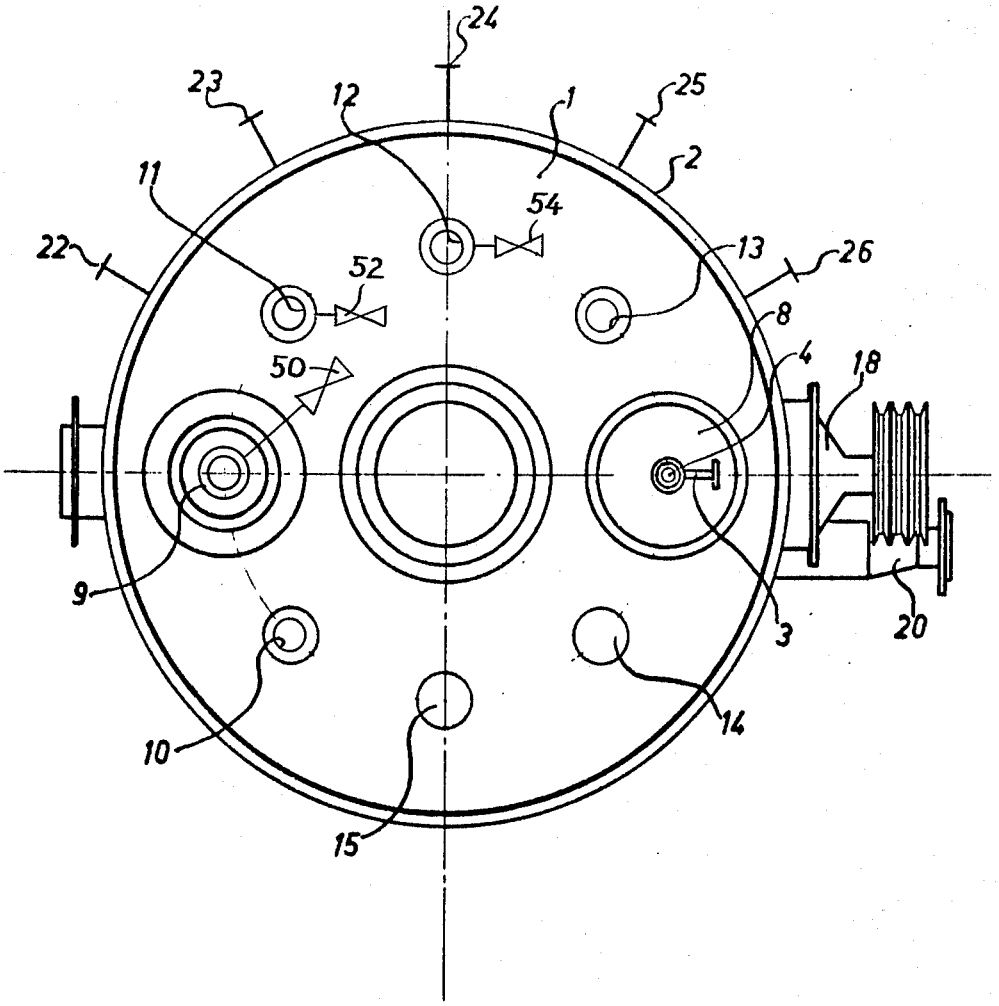
FIG. 2 is a schematic plan view of the apparatus represented in FIG. 1.
Figure 3:
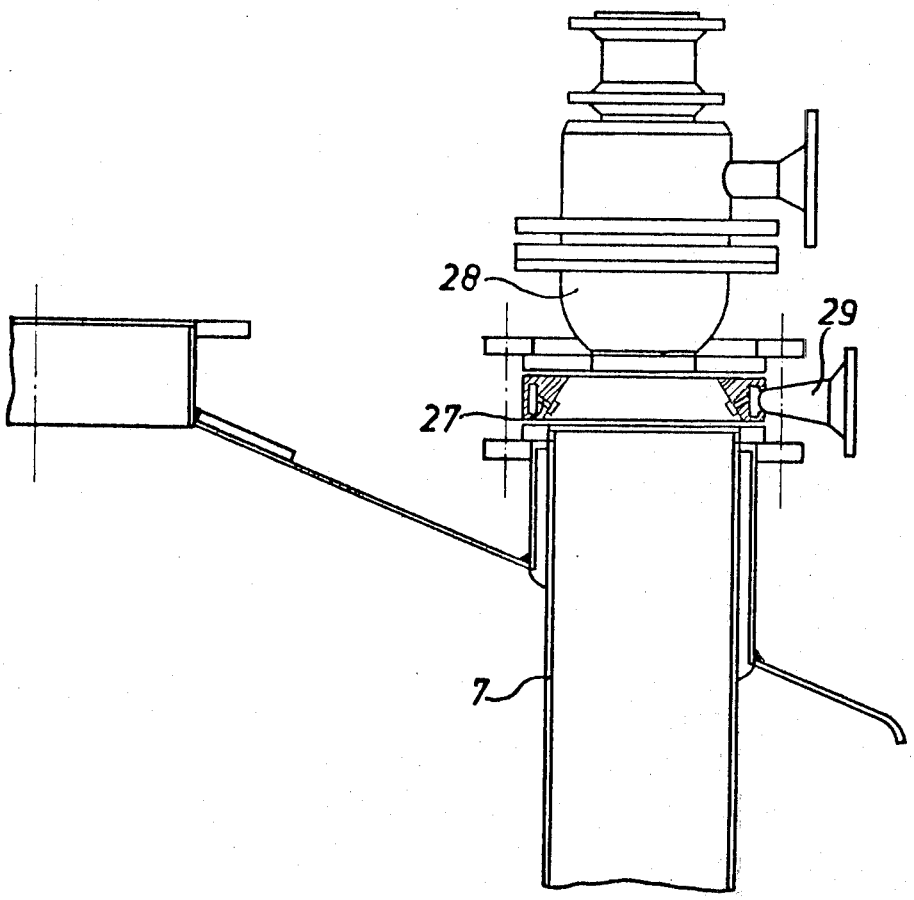
FIG. 3 is a partial view in elevation and in cross section showing a different embodiment of the apparatus for the recovery of fibrils according to the invention.

As is apparent from FIGS. 1 to 3, the apparatus for the recovery, in the form of a suspension in a liquid, of fibrils made of synthetic polymer produced in the presence of vapors of an organic solvent consists of a closed chamber 1 which is heat-insulated and equipped with controllable heating means such as a jacket 2 through which steam passes. Chamber 1 includes a side wall 40, a top wall 42 and a bottom wall 44.

In its upper part, closed chamber 1 has a means for introducing fibrils and solvent vapors. This means includes (1) a device for producing fibrils comprising a pipe 3 for supplying a two-phase solution of molten polymer and solvent which is under the conditions of temperature and pressure necessary for the production of fibrils, a pipe 4 for supplying added fluid for shredding the fibrils and a pressure release spinneret 5, and (2) a tubular pipe 7 which has a valve 6 and enters the closed chamber via an opening 8 in top wall 42. Devices for the production of fibrils by flash spinning such as by suddenly releasing the pressure acting on two-phase solutions of molten polymer are well known in the art, and any such device can be used in the present invention.

In its upper part, the closed chamber 1, as best seen in FIGS. 1 and 2 also has a pipe 9 which extends through an opening in top wall 42. Pipe 9 is for discharging the solvent vapors and is connected, via a pressure actuated valve 50 to a recovery installation (not shown). As best seen in FIG. 2, in the upper part of chamber 1, pipes 10, 11, 12 and 13 extend through openings in top wall 42. Pipe 10 is used for injecting the liquid for suspending the fibrils into the closed chamber 1. Pipe 11 is used for introducing solvent vapors into the closed chamber 1, should this be necessary, and is provided with a pressure actuated valve 52. Pipe 12 is used for introducing an inert gas into the closed chamber 1, should this be necessary, and is provided with a pressure actuated valve 54. Pipe 13 is used for injecting a portion of the suspension of fibrils into the closed chamber 1, should this be necessary. Top wall 42 has openings 14 and 15 which make it possible to connect equipment for measuring, recording and/or controlling the pressure and temperature inside the closed chamber and an inspection opening 17. These openings, of course, are sealed and do not permit entry of air into closed chamber 1. As seen in FIG. 1, side wall 40 in the upper part of closed chamber 1 contains an opening 16 connected to a device such as a hydraulic guard device 56 which limits the rise in pressure inside the closed chamber 1 to a predetermined maximum value.

In its lower part, the closed chamber 1 includes a stirrer with blades 18, and an opening 19 for discharging the suspension of fibrils connected to a pipe 20 equipped with a by-pass 21 which makes it possible to recycle a portion of the suspension to the closed chamber 1 via pipe 13.

Moreover, as best seen in FIG. 2, on its side wall, the closed chamber 1 is equipped with level indicators 22, 23, 24, 25 and 25 which make it possible to check the quantity of liquid present in the closed chamber.

According to a preferred embodiment of the present invention shown in detail in FIG. 3, the pipe 10 provided for injecting the liquid for suspending the fibrils is dispensed with and the liquid is injected through spray devices or nozzles 27 which are arranged in a ring around the device 28 for the production of fibrils. Spray devices 27 are supplied with liquid via the pipe 29. Spray devices 27 are located in the tubular pipe 7 and point in such a way as to promote the forward movement of the fibrils through pipeline 27.

The apparatus for the recovery of fibrils according to the invention is further explained by the example of its realization and use which now follows and which is given purely by way of illustration.

EXAMPLE

An apparatus for the recovery of fibrils, as represented in FIGS. 1 and 2, is used, the diameter of the closed chamber being 2,400 mm and its volume being of the order of 10 $m^3$.

The diameter of the tubular pipe 7 introducing the fibrils and the solvent vapors into the closed chamber is 50 mm.

The stirrer 18 with a horizontal axle is equipped with 3 blades of 400 mm and revolves at a rate of the order of 330 revolutions/minute.

The opening 16 is connected to a hydraulic guard device 56 of 500 mm of water so that the pressure inside the closed chamber cannot exceed 1.05 atmospheres absolute.

Before starting up the installation, approximately 5 $m^3$ of water heated to 85°C are introduced into the closed chamber to form a water level 30 so that the tube 7 dips into this water to a depth of the order of 200 mm, and the apparatus is purged of the air which it contains.

Finally, the devices for checking and maintaining the pressure inside the closed chamber are adjusted so as to maintain a pressure of 1.03 atmospheres absolute inside the latter when it is functioning normally, and the entire apparatus is thermostatted at 85°C.

The apparatus thus described is used under the working conditions below:

A solution of high density polyethylene in technical hexane is introduced continuously via pipe 3 into spinneret 5. The concentration of the solution is 120 g of polymer per kg of solution. This solution is at a temperature of 205°C and at a pressure of 85 kg/$cm^2$ and it is fed at the rate of 15 kg of polymer/hour.

At the inlet to spinneret 5, the solution is subjected to a pre-pressure release of 10 kg/$cm^2$ in order to bring about the formation of the two-phase liquid mixture which leads, during the subsequent sudden release of pressure, to the formation of a continuous fibrillated structure.

This continuous fibrillated structure is shredded directly by a transverse stream of saturated hexane vapor introduced at a pressure 0f 2 kg/$cm^2$ and a rate of 500 kg/hour, via the pipeline 4.

The short polyethylene fibrils thus produced and the hexane vapors evolved are conveyed via the pipe 7 into the stirred suspending liquid, that is to say into the water present in the closed chamber.

The hexane vapors (boiling point: 69°C) escape towards the top of the closed chamber and are drawn off continuously via pipe 9 and are conveyed towards the recovery installation.

Water is introduced continuously via pipe 10 at a flow rate of 1 $m^3$/hour, while an aqueous suspension of fibrils, in which the concentration of fibrils is 1.5% by weight, is drawn off continuously via pipe 20 at a flow rate of 1 $m^3$/hour. This very homogeneous and well dispersed suspension can be converted easily into a high quality paper by the conventional paper-making method.

The suspending of the fibrils in the water can be improved, if necessary, by introducing into this water a surface-active agent such as, for example, sodium lauryl-sulphonate, used at the rate of 50 to 500 g per $m^3$ of water.

In order to improve the stirring of the medium in suspension and consequently the quality of the pulp drawn off, it is possible to draw pulp off continuously via the bypass 21 and to recycle it continuously into the closed chamber via pipe 13. The flow rate of this portion can be as much as 30 $m^3$/hour.

In order to ensure that the apparatus functions in complete safety, the means for checking and maintaining the pressure inside the closed chamber are adjusted so that: (1) the slight variations in pressure relative to the working pressure (1.03 atmospheres absolute) are compensated by operating on the valve 50 which controls the rate at which the hexane vapors are extracted via the pipe 9, (2) an internal pressure of 1.045 atmospheres absolute triggers the stopping of the supply of shredding fluid to the spinneret 5; (3) an internal pressure below 1.02 atmospheres absolute causes hexane vapors to be injected via pipe 11 at a flow rate which can be as much as 150 kg/hour; and (4) an internal pressure below 1.015 atmospheres absolute causes an inert gas, at 30°C, to be injected at a flow rate of 15 $m^3$/hour via pipe 12.

It will be understood that the above description of the present invention is susceptible to various modifications, changes and adaptations, and the same are intended to be comprehended within the meaning and range of equivalents of the appended claims.

We claim:

1. Apparatus for the recovery, in the form of a suspension in a liquid, of fibrils made of synthetic polymer which are in the presence of vapors of an organic solvent, comprising: a closed chamber for containing a liquid for suspending the fibrils and a gaseous atmosphere; a tubular pipe which extends inside the closed chamber and opens into the liquid for suspending the fibrils, the tubular pipe being for introducing the fibrils and solvent vapors into the closed chamber; means for discharging the solvent vapors from the closed chamber; means for introducing liquid into the closed chamber for suspending the fibrils; means for drawing off the suspension of fibrils from the closed chamber; means for controlling the pressure which prevails inside the closed chamber and preventing entry of air into the closed chamber; means for recycling to the closed chamber, a portion of the suspension of fibrils extracted by the means for drawing off the suspension of fibrils from the closed chamber; means in the closed chamber for stirring the liquid for suspending the fibrils; means for keeping the level of liquid for suspending the fibrils constant; means for introducing into the closed chamber vapors of the organic solvent which opens into the gaseous atmosphere and is regulated by the means for controlling the pressure; means for introducing into the closed chamber an inert gas which opens into the gaseous atmosphere and is regulated by the means for controlling the pressure; and means for thermostatting the closed chamber.

2. Apparatus according to claim 1, wherein the means for introducing the liquid for suspending the fibrils consists of spray means arranged in a ring in the tubular pipe.

3. Apparatus for the recovery, in the form of a suspension in a liquid, of fibrils made of synthetic polymer which are in the presence of vapors of an organic solvent, comprising: a closed chamber for containing a liquid for suspending the fibrils and a gaseous atmosphere; a tubular pipe which extends inside the closed chamber and opens into the liquid for suspending the fibrils, the tubular pipe being for introducing the fibrils and solvent vapors into the closed chamber; means for discharging the solvent vapors from the closed chamber; spray means for introducing liquid into the closed chamber for suspending the fibrils; means for drawing off the suspension of fibrils from the closed chamber; means for controlling the pressure which prevails inside the closed chamber and preventing entry of air into the closed chamber; means for recycling to the closed chamber, a portion of the suspension of fibrils extracted by the means for drawing off the suspension of fibrils from the closed chamber; means in the closed chamber for stirring the liquid for suspending the fibrils; means for keeping the level of liquid for suspending the fibrils constant; means for introducing into the closed chamber vapors of the organic solvent which opens into the gaseous atmosphere; means for introducing into the closed chamber an inert gas which opens into the gaseous atmosphere; and means for thermostatting the closed chamber.

4. Apparatus for the recovery, in the form of a suspension in a liquid, of fibrils made of synthetic polymer which are in the presence of vapors of an organic solvent, comprising: a closed chamber for containing a liquid for suspending the fibrils and a gaseous atmosphere; a tubular pipe which extends inside the closed chamber for introducing the fibrils and solvent vapors into the closed chamber; means for discharging the solvent vapors from the closed chamber; spray means for introducing liquid into the closed chamber for suspending the fibrils and arranged in a ring in the tubular pipe; means for drawing off the suspension of fibrils from the closed chamber; means for controlling the pressure which prevails inside the closed chamber and preventing entry of air into the closed chamber; means for recycling to the closed chamber, a portion of the suspension of fibrils extracted by the means for drawing off the suspension of fibrils from the closed chamber; means in the closed chamber for stirring the liquid for suspending the fibrils; means for keeping the level of liquid for suspending for fibrils constant; and means for introducing into the closed chamber vapors of the organic solvent which opens into the gaseous atmosphere.

5. Apparatus according to claim 4, wherein the tubular pipe opens into the liquid for suspending the fibrils.

6. Apparatus according to claim 4, wherein the means for introducing vapors of the organic solvent which opens into the gaseous atmosphere is regulated by the means for controlling the pressure.

7. Apparatus according to claim 4, wherein the closed chamber includes means for introducing an inert gas which opens into the gaseous atmosphere and is regulated by the means for controlling the pressure.

8. Apparatus according to claim 4, wherein the closed chamber is equipped with means for thermostatting it.

* * * * *